US005452900A

United States Patent [19]

Skratulia et al.

[11] Patent Number: 5,452,900

[45] Date of Patent: Sep. 26, 1995

[54] METHOD OF PLAYING A WAGERING GAME

[76] Inventors: John Skratulia, 11402 Howard St., Whittier, Calif. 90601; Fred Wolf, 10418 Lubao Ave., Chatsworth, Calif. 91311

[21] Appl. No.: 415,438

[22] Filed: Apr. 3, 1995

[51] Int. Cl.[6] ..... A63F 1/00

[52] U.S. Cl. ..... 273/292

[58] Field of Search ..... 273/292, 274, 273/309, 85 CP

[56] References Cited

U.S. PATENT DOCUMENTS

| | | | |
|---|---|---|---|
| 5,226,661 | 7/1993 | Wolf | 273/274 |
| 5,248,142 | 9/1993 | Breeding | 273/138 R |
| 5,395,119 | 3/1995 | Jacob et al. | 273/274 |
| 5,417,430 | 5/1995 | Breeding | 273/292 |

OTHER PUBLICATIONS

"California Blackjack"–a brochure by The Commerce Casino 6131 E. Telegraph Rd., Commerce, Calif. 90040.

"Blackjack Jokers"–a brochure by The Normandie Casino 1045 W. Rosecrans Ave., Gardena, Calif. 90247.

*Primary Examiner*—Benjamin H. Layno

*Attorney, Agent, or Firm*—Timothy T. Tyson; Ted Masters; Freilich, Hornbaker & Rosen

[57] ABSTRACT

A method of playing a wagering game 20 between a plurality of players wherein each player places a wager 500 and an action player is selected. Commencing with the action player, hands of any one of a plurality of different games are dealt to the players (step 28). The action player and the next sequential player expose and compare hands (step 30). The winning player collects the wager 500 of the losing player (step 32). Play continues with the next sequential player exposing his/her hand and comparing it with the hand of the previous winner (step 34). The winning player collects the wager 500 of the losing player (step 36). The steps of exposing and comparing (step 34), and collecting (step 36) are repeated sequentially until all players have participated. In a preferred embodiment, players are afforded the opportunity of placing first 601, second 602, and third 603 wagers, each of which is apportioned in the above manner.

28 Claims, 8 Drawing Sheets

METHOD OF PLAYING A WAGERING GAME

TECHNICAL FIELD

The present invention pertains generally to games and more particularly to wagering games.

BACKGROUND ART

The present invention constitutes a novel wagering game for which no applicable prior art has been identified. The present invention can be applied as an adjunct to numerous existing games such as Pan Nine, Pai Gow Poker, California Blackjack (22), and Blackjack Jokers (21) can be employed as a portion of the present invention. Sources well known in the art of Pan Nine and Pai Gow Poker include Mason Malmuth, "The Gambling Theory and Other Topics" (Las Vegas: Mason Malmuth, ©1990); Bill Zender, "Pai Gow Poker" (Las Vegas: Bill Zender, ©1991); Stanford Wong, "Optimal Strategy for Pai Gow Poker" (La Jolla: Pi Yee Press ©1992); George Allen, "How to Play Pai Gow Poker (Tempe: George Allen, ©1988); and Mike Caro, "Caro's Professional Pai Gow Poker Report and Banker Guidelines" (Las Vegas: Mike Caro, ©1986). A source of information on California Blackjack is The Commerce Casino, 6131 East Telegraph Road, Commerce, Calif. 90040. A source of information on Blackjack Jokers is The Normandie Casino, 1045 W. Rosecrans Avenue, Gardena, Calif. 90247.

DISCLOSURE OF INVENTION

The present invention is directed to a wagering game which is played by a plurality of players. The game which is called "Fast Action Bank" is a new method of apportioning game wagers that can be applied as an adjunct to virtually any existing banking game such as Pan Nine, Pai Gow Poker, California Blackjack (22), Blackjack Jokers (21), or any new banking game that may be initiated by a casino. The present invention augments the play of the existing banking game by providing a novel wagering method, wherein players compare hands and settle wagers in a sequential manner. Player skill in recognizing and choosing advantageous seating positions becomes paramount in playing banking games employing the present invention. The present invention holds appeal for small limit players as well as those who enjoy higher stakes, and also affords the opportunity to win a large amount for a small investment.

In accordance with a preferred embodiment, the players each place a wager. An action player is then selected, preferably by lot. Commencing with the action player the dealer sequentially deals hands of the selected banking game to the players. After the player's hands are appropriately set or drawn to depending upon the selected gamer the action player and the first sequential player expose and compare hands. The player with the best hand collects the wager of the other player. The next sequential player then exposes his/her hand and compares it with that of the previous winner. Again, the player with the best hand collects the wager of the other player. This process is sequentially repeated until all players have participated.

In accordance with an important aspect of the invention the action player is determined by the winner of the previous hand rolling a plurality of dice and sequentially counting players until the total numeric value of the dice is reached.

In accordance with another important aspect of the inventions the wagers of all players are the same and equal a predetermined table limit.

In accordance with another important feature of the invention, it can be applied to a plurality of existing banking games.

In accordance with a preferred embodiment of the invention, players may place a plurality, three being preferred, of wagers of different amounts which are apportioned sequentially. In one embodiment the largest wager is apportioned first, followed by the next largest wagers and thereafter similarly proceeding to the smallest wager.

In accordance with an important aspect of the invention, the predetermined table limits include;

| | |
|---|---|
| First Wager | S 10 |
| Second Wager | 50 |
| Third Wager | 100 |

In accordance with a preferred embodiment of the invention, an action player and a supplemental action player are selected, the supplemental action player commencing the settlement of second and third wagers.

Other features and advantages of the present invention will become apparent from the following detailed description, taken in conjunction with the accompanying drawings, which illustrate, by way of examples the principles of the invention.

MODES FOR CARRYING OUT THE INVENTION

Figure 1:
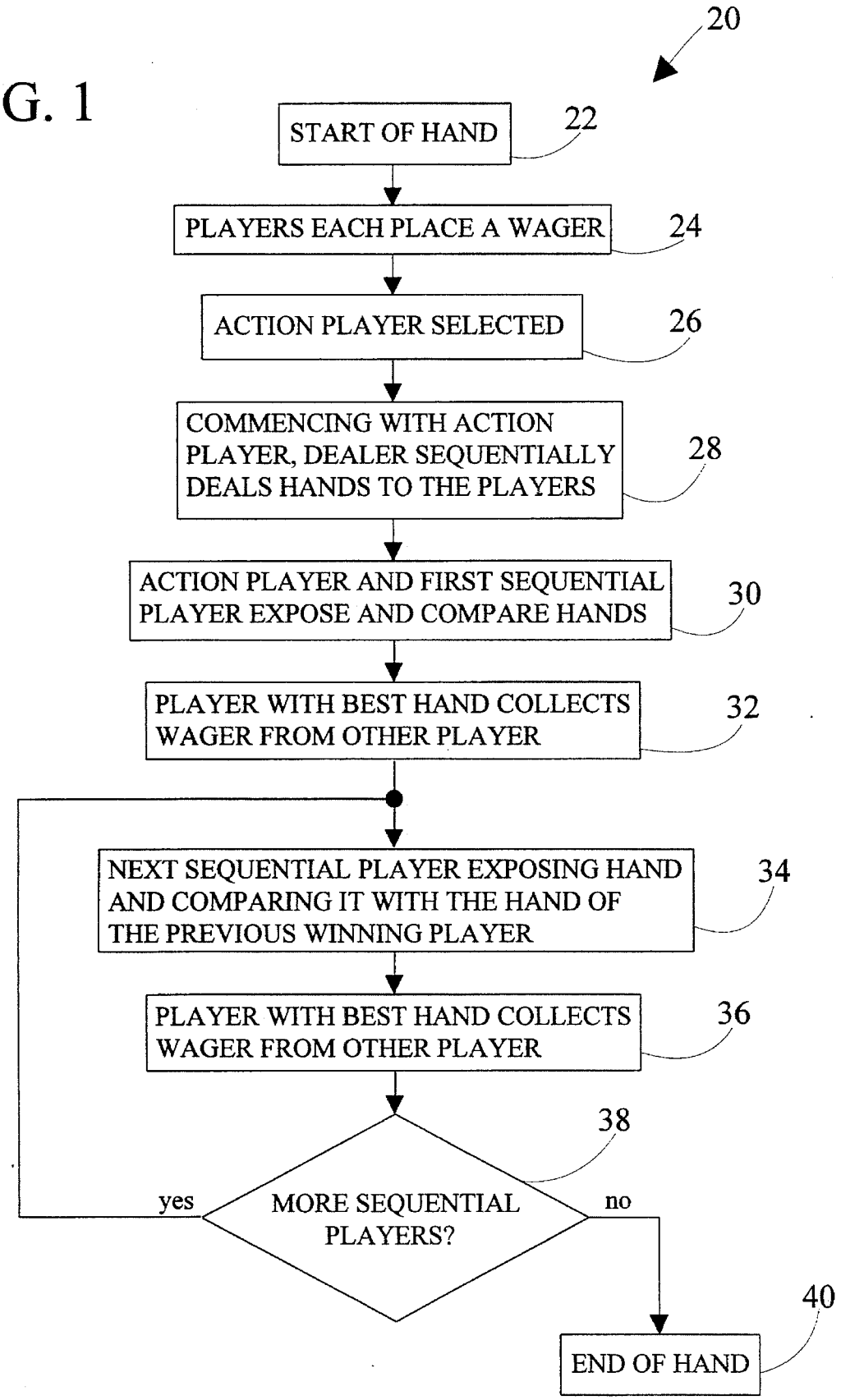
FIG. 1 is a flow diagram illustrating the steps and method of play of a game in accordance with the present invention.
Figure 2:
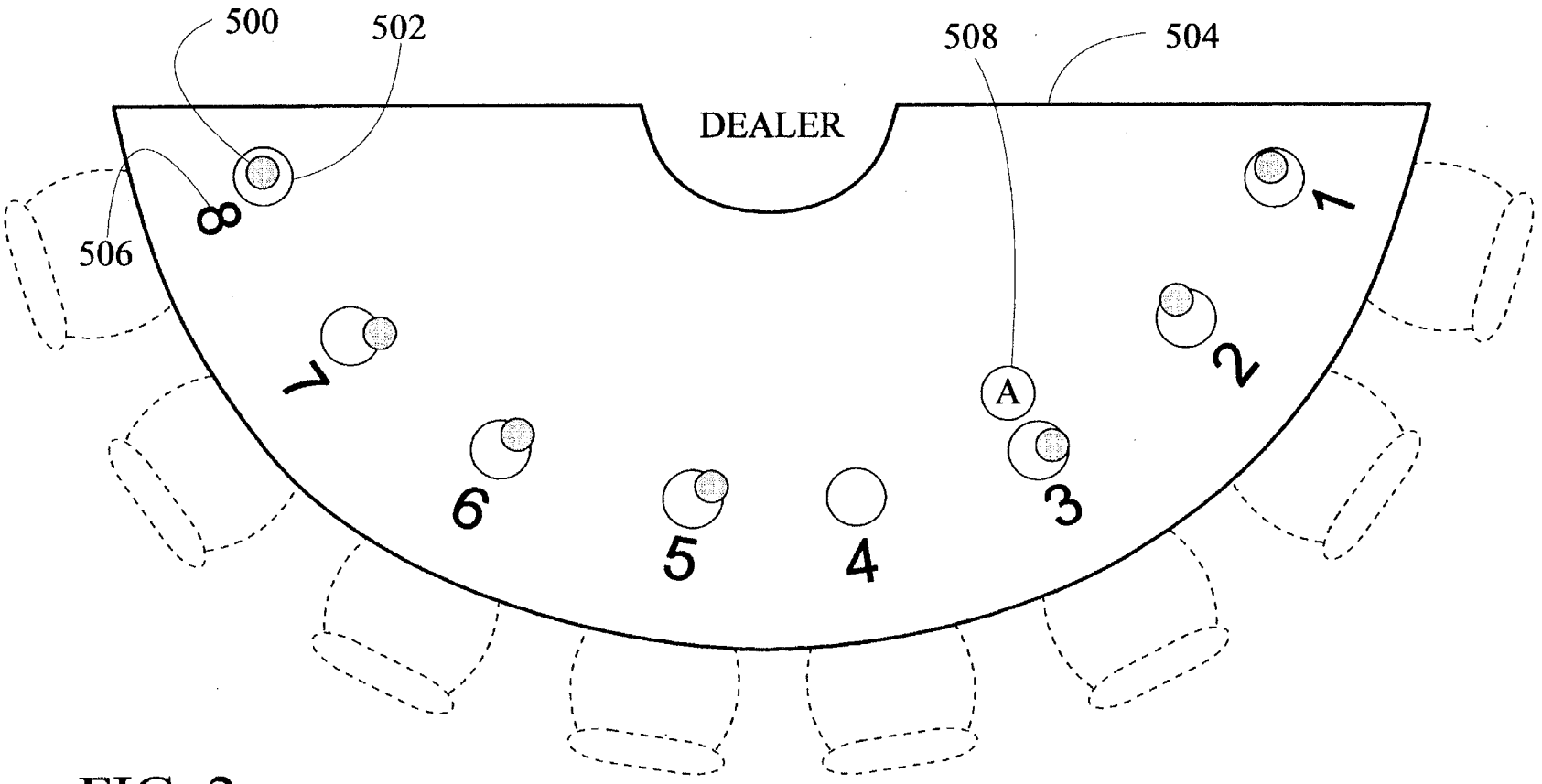
FIG. 2 is a plan view of a playing table layout.

Referring initially to FIGS. 1 and 2, there are depicted a flow diagram illustrating the steps and method of play and the table layout, respectively, of a wagering game wherein wagers are apportioned between a plurality of game players in accordance with the present invention, generally designated as 20. The wagering game includes a plurality of players and a dealer, and is especially suited for play at a casino or other gaming establishment. The wagering game and method disclosed herein is utilized in conjunction with and as an adjunct to any one of a plurality of different games including but not limited to such games as Pan Nine, Pai Gow Poker, California Blackjack (22), and Blackjack Jokers (21). Depending upon the game selected, a standard 52 card deck, a special card deck, or other playing media such as tiles could be employed. Players draw or set their hands in accordance with the rules of the particular selected game.

A hand begins with start terminator step 22. In step 24 the dealer calls for wagers 500 and the players place their wagers 500 in betting areas 502 directly in front of them on playing table 504. In a preferred embodiment, the wagers of all players are the same and equal a predetermined table limit. In another preferred embodiment, step 24 further includes each player contributing a predetermined collection amount to the dealer. The playing table 504 includes playing positions 506 for a plurality of players, between three and eight players being preferred. Indicia depicting the betting areas 502, playing positions 506, or other pertinent information can be disposed upon the surface of the playing table 504 or a covering thereof. In step 26 an action player is selected and an action button (also known as a Fast Action Bank button) 508 is placed in front of the selected player, player 3 in the example shown in FIG. 2. In step 28, commencing with the action player, the dealer sequentially deals hands to the players. Depending upon the game being played, the action player will be dealt the first card or will receive the first hand. As was previously disclosed, the hand may be for any one of a plurality of different games. The action player is also the first player to open his/her hand when settling bets. In step 30 the action player and the first sequential player expose and compare hands. The direction of sequential action may either be clockwise which is preferred, or counterclockwise. In step 32, of the two contending players, the player with the best hand (winner), in accordance with the rules of the selected game, collects the wager 500 from the other player (loser). In step 30, if the two contending players tie, no wager is collected by either player, and the action player is denoted the winner and continues to play. In step 34 the next sequential player exposes his/her hand and it is compared with the hand of the previous winning player from step 32. In step 36, of the two contending players, the player with the best hand (winner) collects the wager 500 from the other player (loser). In step 34, if the two contending players tie, no wager is collected by either player, and the previous winning player continues to play. In step 38, if there are more sequential players (yes), steps 34 and 36 are repeated until all players have participated. In step 38, if there are no more sequential players (no), the game proceeds to end terminator step 40 and the hand is concluded.

By way of example, in FIG. 2 assume that after the deal and draw or setting the players hands are ranked as follows:

Player 1—second best

Player 2—best

Player 3—fifth best

Player 4—position not occupied

Player 5—third best (tie with Player 7)

Player 6—seventh best

Player 7—third best (tie with Player 5)

Player 8—sixth best

Player 3 (the action player) would compare hands with Player 5 (since playing position 4 is not occupied), resulting in Player 5 winning Player 3's wager. Player 6 would then compare hands with Player 5, resulting in Player 5 winning Player 6's wager. Player 7 would then compare hands with Player 5, resulting in neither player winning a wager and Player 5 (the previous winner or incumbent player) continuing play. Player 8 would then compare hands with Player 5, resulting in Player 5 winning Player 8's wager. Player 1 would then compare hands with Player 5, resulting in Player 1 winning Player 5's wager. And finally, Player 2 would then compare hands with Player 1, resulting in Player 2 winning Player 1's wager. It is noted that the location of the action player is very important in determining how many wagers a player will win. In the example cited, Player 5 with the third best hand wins three wagers, Player 7 also with the third best hand wins no wagers, Player 1 with the second best hand only wins one wagers, and Player 2 with the best hand only wins one wager.

In order for the present invention to be better compatible with certain selected games, appropriate modifications to the rules of those games are desirable. For example, in the game of Pan Nine a player must stand on 7 and above, and a tie hand results in no collection of wager from either player, and the previous winning player continues play with the next sequential player. In the game of Pai Gow Poker having front and back hands, in order for a player to win, he/she must either win both the front and the back hands, or win one hand and tie the others and if each player wins one hand, no wager is collected from either player, and the stronger two-card hand continues play with the next sequential player. Or alternatively, the original or incumbent player continues to play with the next sequential player. And, for the game of California Blackjack if a player has two aces, subsequent players do not draw to their hands unless they are making the second and third wager and the natural does not cover (refer to the discussion of FIGS. 4 through 7). Also for the game of California Blackjack, players must stand on 21. It is appreciated that at the discretion of the casino, numerous other modifications to the rules of the aforestated games, or to other selected games, can be effected.

FIG. 2 is a plan view of a playing table layout showing wager 500, betting area 502, table 504, playing position 506, and action button 508. For simplicity wager 500, betting area 502, and playing position 506 have been designated for only one of the eight playing positions 506.

Figure 3:
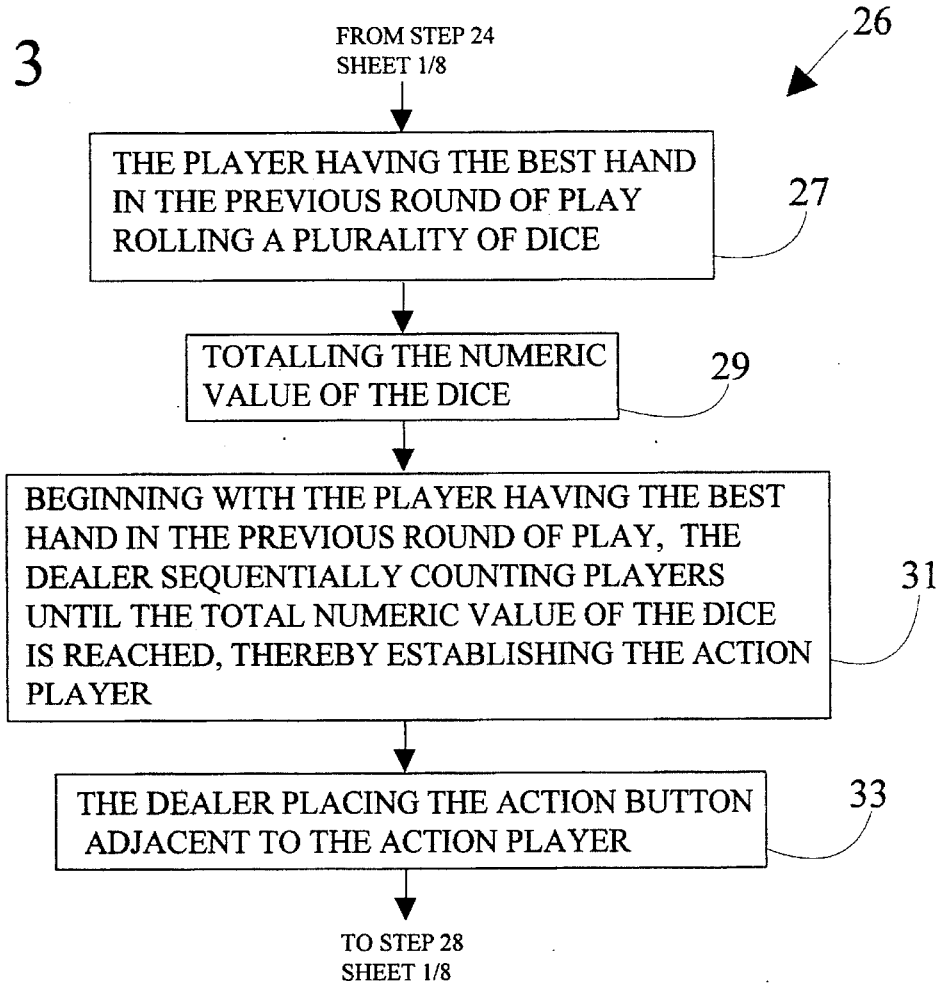
FIG. 3 is an expanded flow diagram of an action player selection procedure.

FIG. 3 is an expanded flow diagram of action player selection procedure step 26 of FIG. 1. The procedure includes providing a plurality of dice, a dice cup, and an action button 508 (refer to FIG. 2). In step 27, the player having the best hand in the previous round of play (hand) shakes and rolls the plurality of dice. Three dice are a preferred number. In step 29, the numeric value of the dice are totalled. In step 31, beginning with the player having the best hand in the previous round of play, the dealer sequentially counts players until the total numeric value determined in step 29 is reached. The direction of sequential counting may be either clockwise which is preferred, or counterclockwise. The player corresponding to the total numeric value is designated the action player. In step 33, the dealer places the action button 508 adjacent to the selected action player. For example, in FIG. 2 assume that the winner of the previous hand was Player 7 and that the total numeric value of the dice was 12. Beginning at Player 7 and counting clockwise 12 places results in Player 3 being designated as the action player. It is noted that since no player occupies playing position 4, that position is not counted. If the winner of the previous hand leaves the game, the dice move (preferably clockwise) to the next player. When a new game starts, the player in the lowest numbered playing position rolls the dice.

As a shortcut method of effecting the count, the roller of the dice may be assigned a series of integer count numbers. The following table lists the integer numbers for various numbers of players:

| | | | | | | |
|---|---|---|---|---|---|---|
| 8 Players | 1 | 9 | 17 | | | |
| 7 Players | 1 | 8 | 15 | | | |
| 6 Players | 1 | 7 | 13 | | | |
| 5 Players | 1 | 6 | 11 | 16 | | |
| 4 Players | 1 | 5 | 9 | 13 | 17 | |
| 3 Players | 1 | 4 | 7 | 10 | 13 | 16 |

For example, in a game of six players and a total numeric value of 10, seven would be subtracted from 10 resulting in a count of 3 positions. It is noted that other action player-determining procedures could also be employed, such as a spinning devices or drawn tokens. Also, the position of the action player could simple rotate around the table for each hand.

Figure 4:
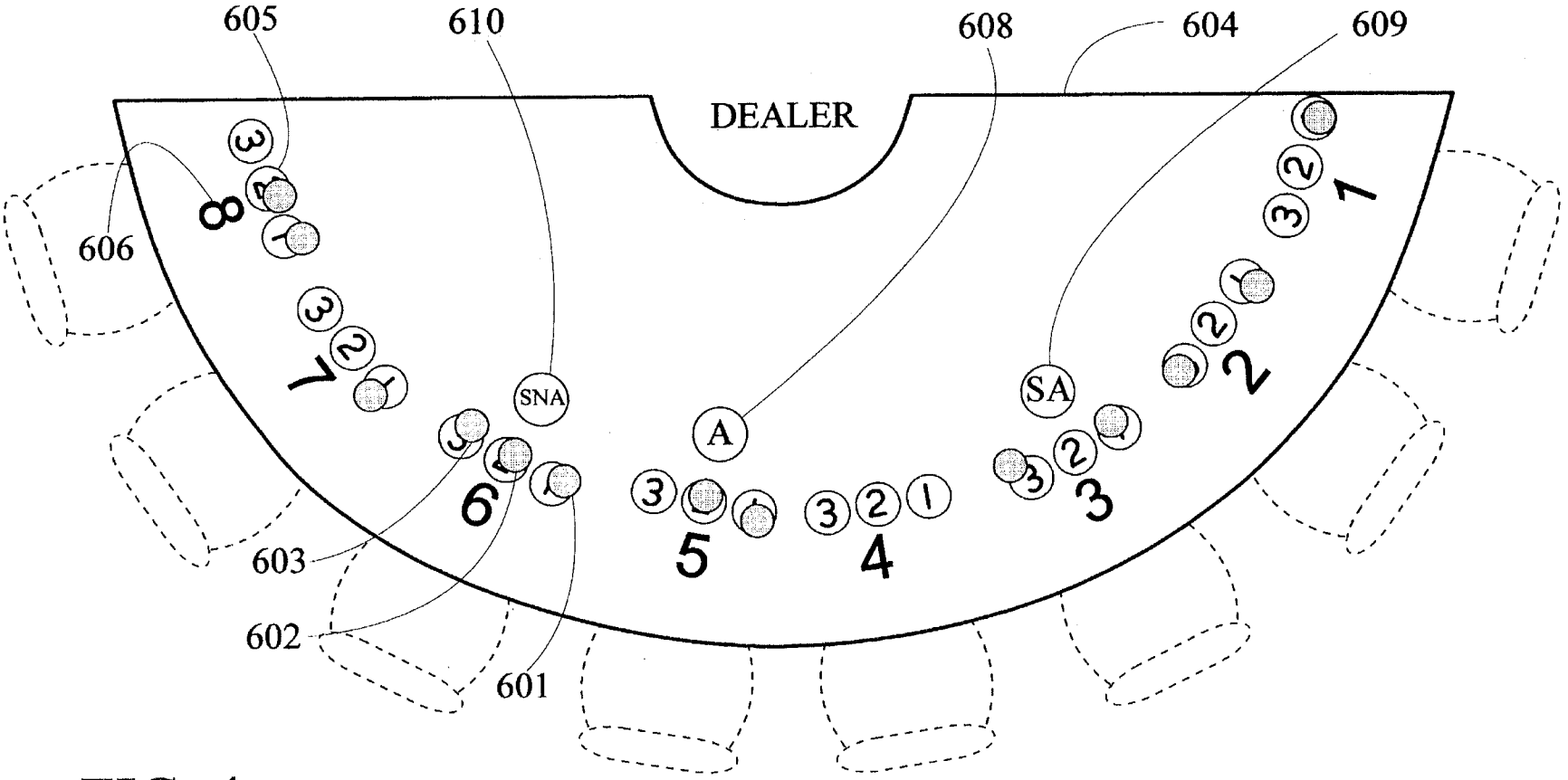
FIG. 4 is a plan view of a playing table layout of a second embodiment.

FIG. 4 is a plan view of a playing table layout of a second embodiment. This embodiment is similar to embodiment 20 of FIG. 1 with the exception that betting area 605 is partitioned into first, second, and third betting circles wherein first, second, and third wagers 601, 602, and 603 respectively may be placed. Playing table 604 includes a plurality of playing positions 606, eight in the shown embodiment. Indicia depicting the betting area 605, playing positions 606, or other pertinent information can be disposed upon the surface of the playing table 604 or a covering thereof. An action button 608 is placed adjacent the selected action player. In a preferred embodiment, the first 601, second 602, and third 603 wagers made by each player are all the same and equal a predetermined table limit. The following predetermined table limits have been found useful:

| | |
|---|---|
| First Wager 601 (first circle bets) | $ 10 |
| Second Wager 602 (second circle bets) | 50 |
| Third Wager 603 (third circle bets) | 100; |
| or, | |
| First Wager 601 (first circle bets) | $ 25 |
| Second Wager 602 (second circle bets) | 100 |
| Third Wager 603 (third circle bets) | 200; |
| or, | |
| First Wager 601 (first circle bets) | $ 100 |
| Second Wager 602 (second circle bets) | 500 |
| Third Wager 603 (third circle bets) | 1000. |

In this second embodiment, players must place a first wager 601, however the second 602 and third 603 wagers are discretionary. In the course of play, the third 603 wagers (third circle bets) are apportioned first, followed by the second wagers 602 (second circle bets), and finally the first wagers 601 (first circle bets). In an alternative embodiment, a player must first place a second wager 602 in order to place a third wager 603.

Figure 5:
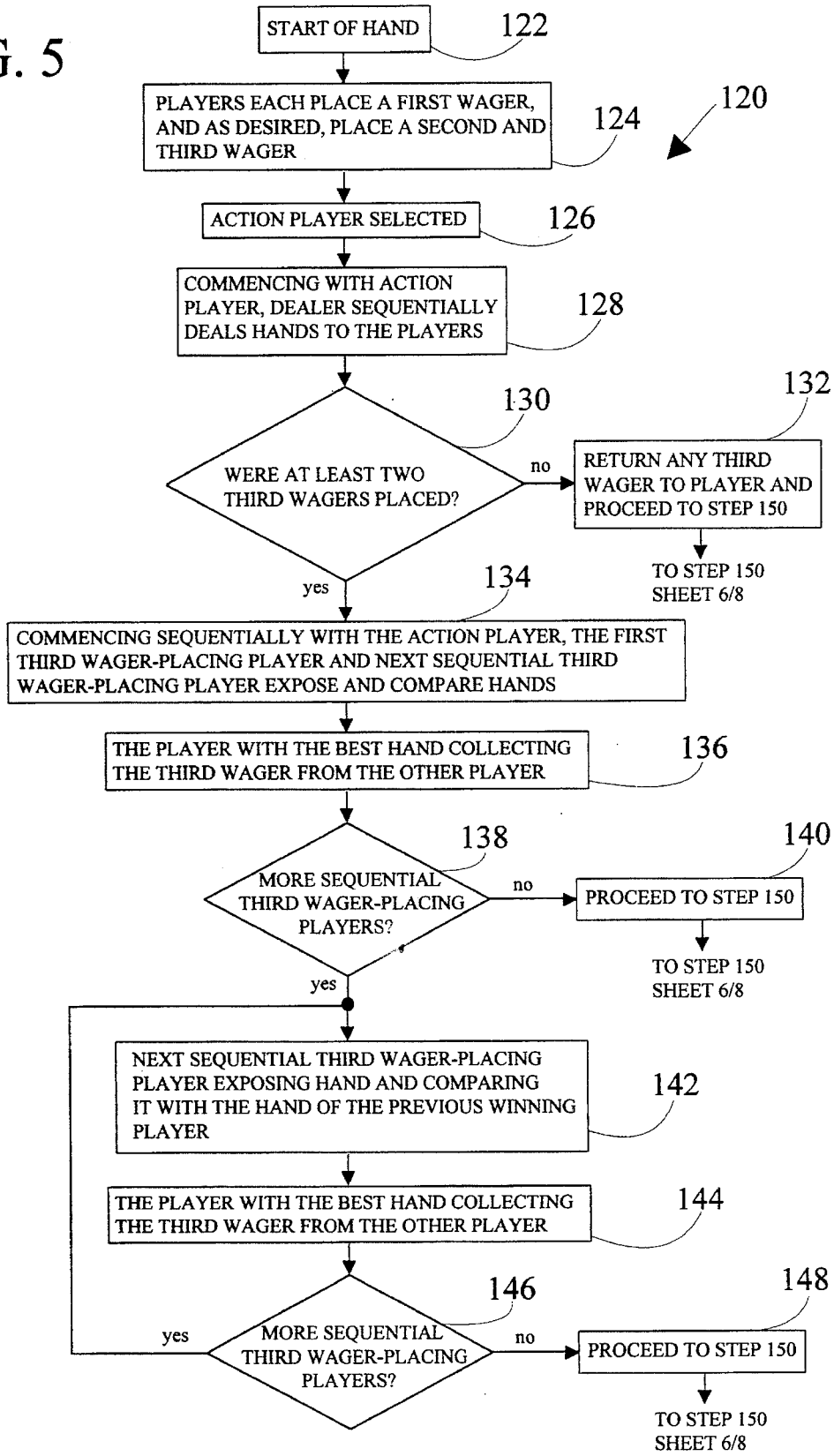
FIG. 5 is a flow diagram of the second embodiment illustrating the procedure for third wager apportionment.

FIG. 5 is a flow diagram of the second embodiment, generally designated as 120, illustrating the procedure for third wager 603 apportionment. A hand begins with start terminator 122. In step 124 the players each place a first wager 601, and as desired, place a second 602 and third wager 603. In step 126 an action player is selected, and an action button 608 is placed in front of the selected player. The method of selecting the action player is the same as that previously described in the discussion of FIG. 3. In step 128, commencing with the action player, the dealer sequentially deals hands to the players and the hands are appropriately set or drawn to. In step 130, it is observed if at least two third wagers 603 were placed. If at least two third wagers 603 were not placed (no), then in step 132 any third wager 603 is returned to the player and the game proceeds with step 150 shown in FIG. 6. If at least two third wagers 603 were placed (yes) the game proceed to step 134 wherein commencing sequentially with the action player, the first third wager-placing player and the next sequential third wager-placing player expose and compare hands. In step 136, of the two contending players, the player with the best hand (winner) collects the third wager 603 from the other player (loser). In step 134, if the two contending players tie, no wager is collected by either player, and the first third wager-placing player continues to play. In step 138, it is observed if there are more sequential third wager-placing players. If there are no more third wager-placing players (no), then in step 140 the game proceeds to step 150 shown in FIG. 6. If there are more third wager-placing players (yes), in step 142 the next sequential third wager-placing player exposes his/her hand and compares it with the hand of the previous winning player. In step 144, the player with the best hand (winner) collects the third wager 603 from the other player (loser). In step 146, it is observed if there are more sequential third wager-placing players. If there are more third wager-placing players (yes), then steps 142 and 144 are repeated until all players have participated. In step 146, if there are no more sequential players (no), then in step 148 the game proceeds to step 150 shown in FIG. 6. In steps 122 through 148 the third wager 603 has been apportioned between all third wager-placing players, and the game proceeds to the apportionment of the second wagers 602.

Figure 6:
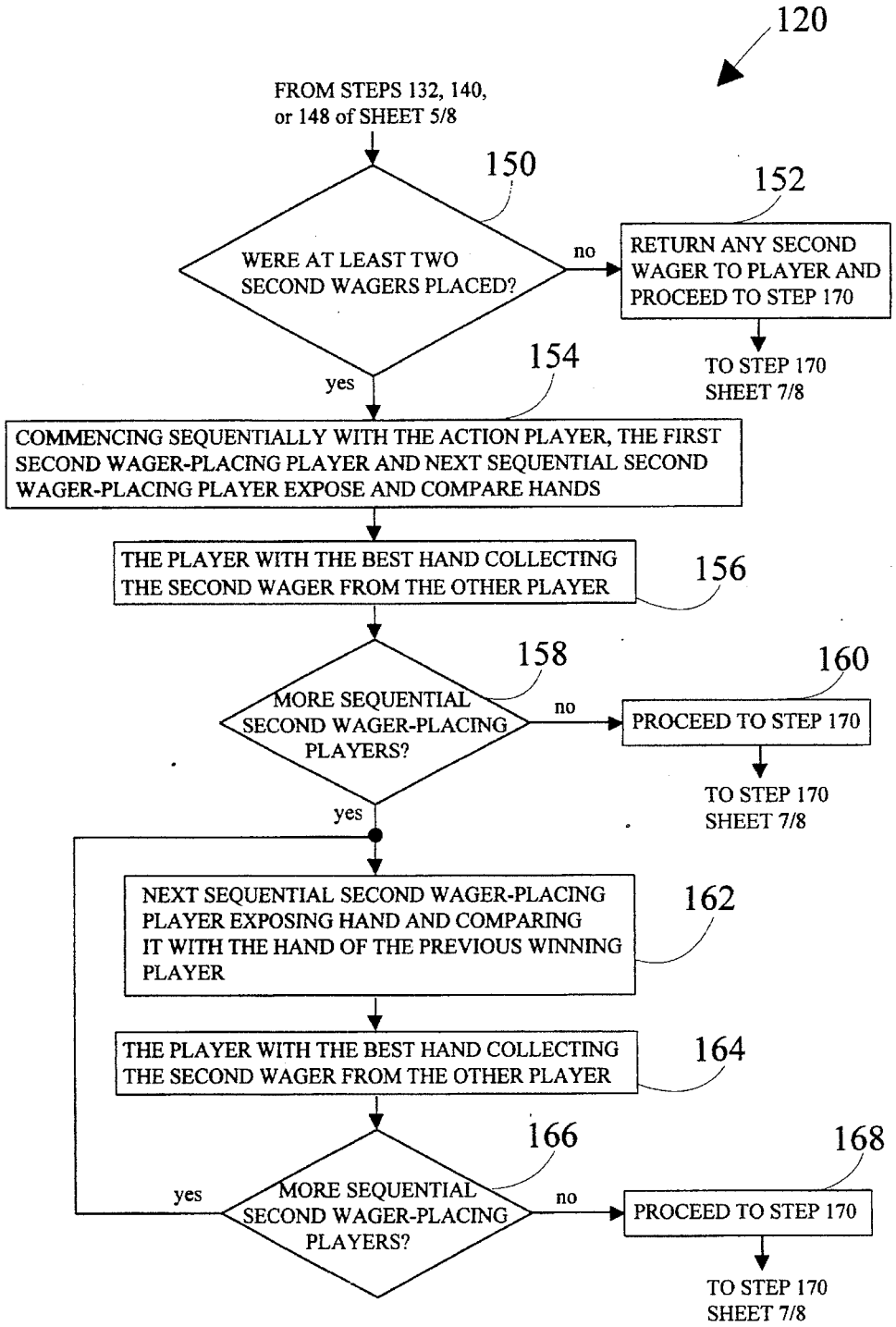
FIG. 6 is a flow diagram of the second embodiment illustrating the procedure for second wager apportionment; and, FIG. 7 is a flow diagram of the second embodiment illustrating the procedure for first wager apportionment.

FIG. 6 is a continuing flow diagram of the second embodiment, generally designated as 120, illustrating the procedure for second wager 602 apportionment. Step 150 follows either step 132, 140, or 148 shown in FIG. 5. In step 150, it is observed if at least two second wagers 602 were placed. If at least two second wagers 602 were not placed (no), then in step 152 any second wager 602 is returned to the player and the game proceeds with step 170 shown in FIG. 7. If at least two second wagers 602 were placed (yes) the game proceed to step 154 wherein commencing sequentially with the action player, the first second wager-placing player and the next sequential second wager-placing player expose and compare hands. It is noted, that the hands of second wager-placing players may already have been exposed if they were also third wager-placing players. In step 156, of the two contending players, the player with the best hand (winner) collects the second wager 602 from the other player (loser). In step 154, if the two contending players tie, no wager is collected by either player, and the first second wager-placing player continues to play. In step 158, it is observed if there are more sequential second wager-placing players. If there are no more second wager-placing players (no), then in step 160 the game proceeds to step 170 shown in FIG. 7. If there are more second wager-placing players (yes), in step 162 the next sequential second wager-placing player exposes his/her hand and compares it with the hand of the previous winning player. In step 164, the player with the best hand (winner) collects the second wager 602 from the other player (loser). In step 166, it is observed if there are more sequential second wager-placing players. If there are more second wager-placing players (yes), then steps 162 and 164 are repeated until all players have participated. In step 166, if there are no more sequential players (no), then in step 168 the game proceeds to step 170 shown in FIG. 7. In steps 150 through 168 the second wager 602 has been apportioned between all second wager-placing players, and the game proceeds to the apportionment of the first wagers 601.

Figure 7:
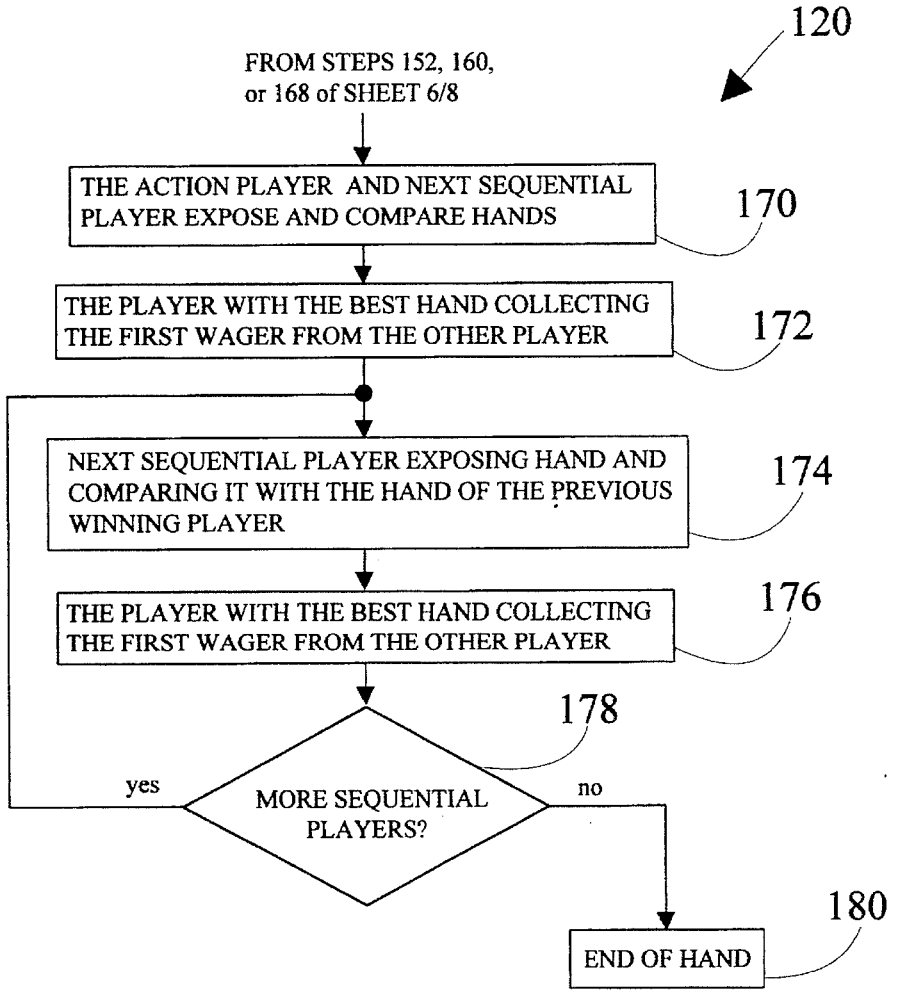

FIG. 7 is a continuing flow diagram of the second embodiment, generally designated as 120, illustrating the procedure for first wager 601 apportionment. Step 170 follows either step 152, 160, or 168 shown in FIG. 6. For first wager 601 apportionment all players necessarily participate since they have all placed a first wager 601. In step 170 the action player and the next sequential player expose and compare hands. It is noted, that the hands of second and third wager-placing players may already have been previously exposed. In step 172, of the two contending players, the player with the best hand (winner) collects the first wager 601 from the other player (loser). In step 170, if the two contending players tie, no wager is collected by either player, and the previous winning player continues to play. In step 174 the next sequential player exposes his/her hand and compares it with the hand of the previous winning player. In step 176, the player with the best hand (winner) collects the first wager 601 from the other player (loser). In step 178, it is observed if there are more sequential players. If there are more sequential players (yes), then steps 174 and 176 are repeated until all players have participated. In step 178, if there are no more sequential players (no), then the game proceeds to end terminator step 180 and the hand is concluded. In steps 170 through 180 the first wager 601 has been apportioned between all players.

By way of example, and referring again to FIG. 4, assume that after the deal and draw or settings the players hands are ranked as follows:

Player 1—second best
Player 2—best
Player 3—fifth best
Player 4—position not occupied
Player 5—third best (tie with Player 7)
Player 6—seventh best
Player 7—third best (tie with Player 5)
Player 8—sixth best Apportionment of the third wager 603 settled first. Since the action player (Player 5) did not make a third wager 603, play would commence with the first sequential third wager-placing player, Player 6 for clockwise play. Player 6 would compare hands with the next sequential third wager-placing player, Player 2, resulting in Player 2 winning Player 6's third wager 603. Winning Player 2 then compares hands with the next sequential third wager-placing player, Player 3, resulting in Player 2 winning Player 3's third wager 603. Since there are no more third wager-placing players, this concludes the apportionment of third wagers 603, wherein Player 2 wins two third wagers 603.

Apportionment of the second wager 602 is settled next. Play commences with Player 5 (the action player) who did make a second wager 602. Player 5 compares hands with the next sequential second wager-placing player, Player 6, resulting in Player 5 winning Player 6's second wager 602. Winning Player 5 then compares hands with the next sequential second wager-placing player, Player 8, resulting in Player 5 winning Player 8's second wager 602. Since there are no more second wager-placing players, this concludes the apportionment of second wagers 603, wherein Player 5 wins two second wagers 602.

Lastly, the apportionment of the first wager 601 is settled. Play commences with Player 5 and Player 6 comparing hands, resulting in Player 5 winning Player 6's first wager 601. Winning player 5 then compares hands with Player 7, resulting in neither player winning a wager and Player 5 (the previous winner or incumbent player) continuing play. Player 5 then compares hands with Player 8, resulting in Player 5 winning Player 8's first wager 601. Player 5 then compares hands with Player 1, resulting in Player 1 winning Player 5's first wager 601. Winning Player 1 then compares hands with Player 2, resulting in Player 2 winning Player 1's first wager 601. Winning Player 2 then compares hands with Player 3, resulting in Player 2 winning Player 3's first wager 601. Since there are no more sequential players, this concludes the apportionment of first wagers 601, wherein Player 5 wins two first wagers 601, Player 1 wins one first wager 601, and Player 2 wins two first wagers 601. This also concludes the hand.

Figure 8:
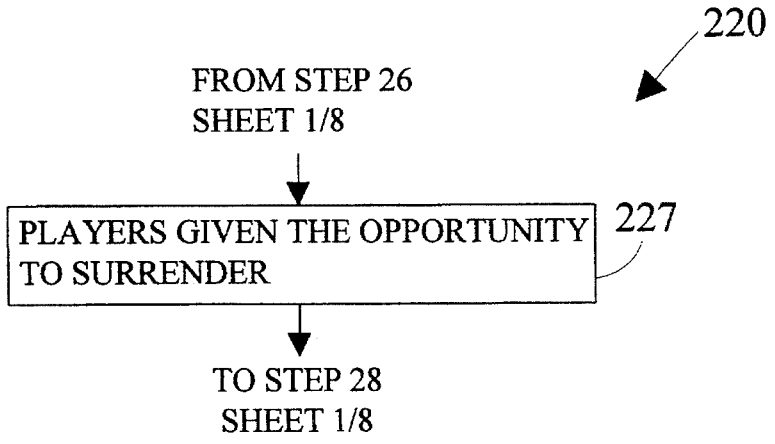
FIG. 8 is a flow diagram of a third embodiment.

FIG. 8 is a flow diagram of a third embodiment, generally designated as 220. In step 227 each player is given the opportunity to surrender and thereby not participate in the hand. For example, surrender could be an attractive option once the player knows that he/she will be in the last playing position and therefore can only win one wager. However, the surrendering player forfeits one-half of his/her wager in so doing. After the action player is selected in step 26 of FIG. 1, the players may surrender. To effect the surrender, the player withdraws one-half of his/her wager and leaves the other forfeited one-half in the betting area 502 (refer to FIG. 2). Play then continues with step 28 of FIG. 1. In the normal course of play, the player who would have compared hands with the surrendering player had the surrendering player not surrendered wins the forfeited one-half wager.

Figure 9:
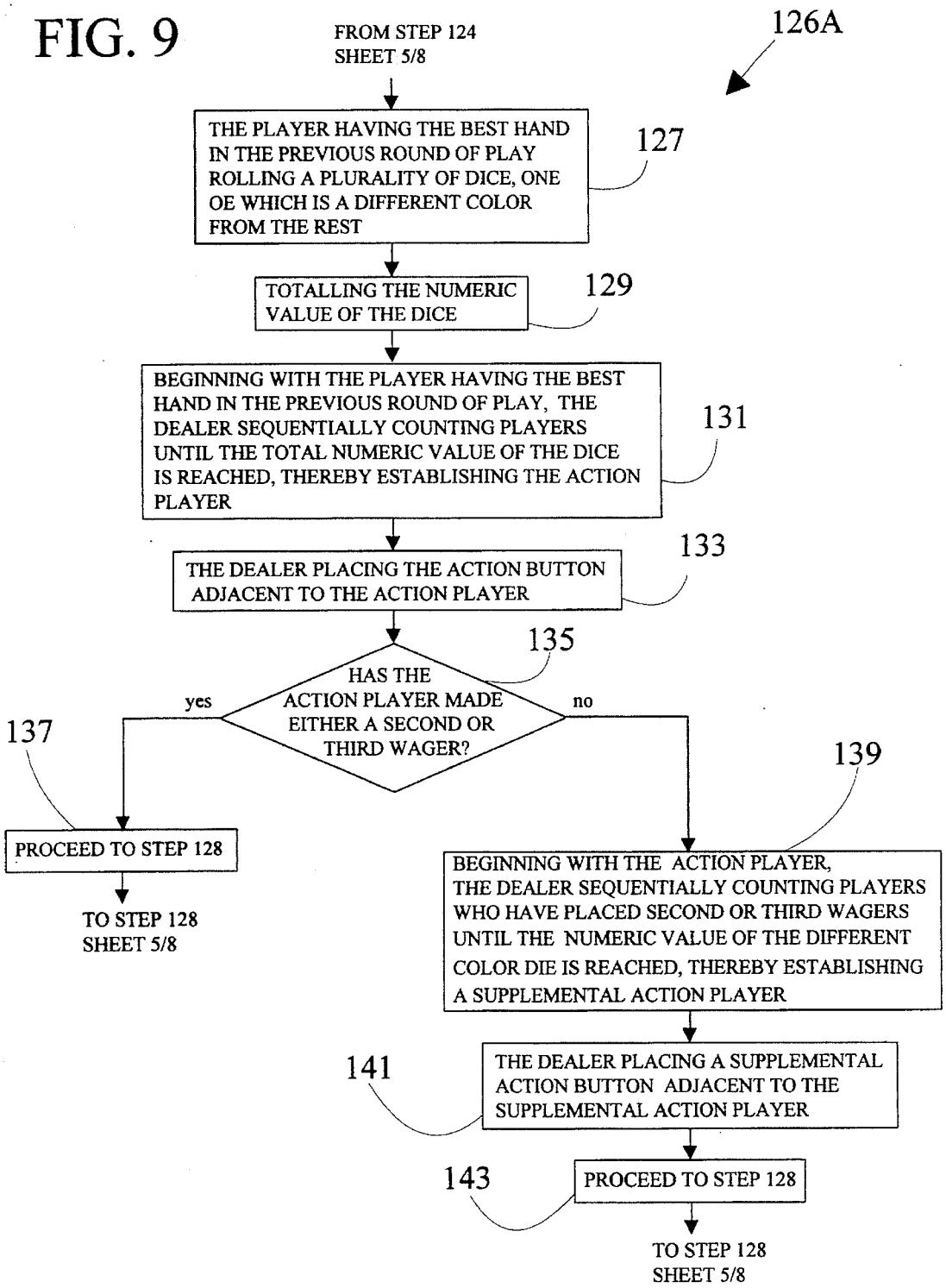
FIG. 9 is an expanded flow diagram of an alternative action player selection procedure.

FIG. 9 is an expanded flow diagram of an alternative action player selection procedure specifically adapted for multiple wagers, designated as 126A. Step 126A differs from step 126 shown in FIG. 5 in that an action player and a supplemental action player are selected. The supplemental action player is the first to expose and compare hands with the next sequential player for settlement of second wagers 602 and third wagers 603 (refer to FIG. 4). The use of a supplemental or second action player serves to more effectively randomize the starting point for the apportionment of second wagers 602 and third wagers 603 and therefore lessens the playing advantage of the more skilled player. Alternative action player selection procedure 126A follows step 124 of FIG. 5. The procedure includes providing a plurality of dicer one of which is a different color from the rest, a dice cups an action button 608 and a supplemental action button 609 (refer to FIG. 4). In step 127, the player having the best hand in the previous round of play (hand) shakes and rolls the plurality of dice. Two white dice and one red die are a preferred embodiment. In step 129, the numeric value of the dice is totalled. In step 131, beginning with the player having the best hand in the previous round of plays the dealer sequentially counts players until the total numeric value in step 129 is reached. The direction of sequential counting may be clockwise which is preferred, or counter-clockwise. The player corresponding to the total numeric value is designated the action player. In step 133, the dealer places the action button 608 adjacent to the selected action player. In step 135, the dealer notes if the action player has placed either a second wager 602 of third wager 603. If the answer is yes and the action player has placed either a second wager 602 or third wager 603, then in step 137 normal play continues with step 128 of FIG. 5. In step 139, if the action player has not placed either a second wager 602 or third wager 603, beginning with the action player the dealer sequentially counts players who have placed second wagers 602 or third wagers 603 until the value of the different color (red) die is reached, thereby establishing a supplemental action player. For example in FIG. 4, assume that the action player is player 7 (not the shown Player 5), and assume that the red die had a value of three. Beginning with Player 8 and counting clockwise three second wager 602 or third wager 603 placing players, results in Player 3 being established as the supplemental action player. In steps 141 the dealer places the supplemental action button 609 adjacent to the supplemental action player. In step 143 play continues with step 128 of FIG. 5. It is noted that when the supplemental action player embodiment is employed, that steps 126 and 134 of FIG. 5 must be slightly altered, as must also step 154 of FIG. 6. In step 126, and action player and a supplemental action player are selected. In steps 134 and 154, wager settlement commences with the supplemental action player.

In an alternative embodiment a supernumerary action player is selected in addition to the action player and supplemental action player. In this embodiment, the supernumerary action player is the first to expose and compare hands with the next sequential player for settlement of third wagers 603 (refer to FIG. 4), the supplemental action player is the first to expose and compare hands with the next sequential player for the settlement of second wagers 602, and the action player is the first to expose and compare hands with the next sequential player for the settlement of first wagers 601. In FIG. 4 the supernumerary action player is located in playing position 6, and a supernumerary action button 610 is placed in front of that player. It is noted that when the supernumerary action player embodiment is employed, that steps 126 and 134 of FIG. 5 must be slightly altered, as must also step 154 of FIG. 6. In step 126, an action player, a supplemental action player, and a supernumerary action player are selected. In steps 134 wager settlement commences with the supernumerary action player, and in step 154 wager settlement commences with the supplemental action player.

The preferred embodiments of the invention described herein are exemplary and numerous modifications, procedural variations, rearrangements, and adjustments can be readily envisioned to achieve an equivalent result, all of which are intended to be embraced within the scope of the appended claims.

We claim:

1. A method of apportioning wagers between a plurality of game players, wherein a dealer deals hands to each player, comprising the steps of:

the players each placing a wager;

selecting an action player;

commencing with the action players the dealer sequentially dealing hands to the players;

the action player and the first sequential player exposing and comparing hands;

the player with the best hand collecting said wager from the other player;

the next sequential player exposing his/her hand and comparing it with the hand of the previous winning player;

the player with the best hand collecting said wager from the other player; and, repeating said steps of the next sequential player exposing his/her hand and comparing it with the hand of the previous winning players and the player with the best hand collecting said wager from the other players until all players have participated.

2. The method according to claim 1, wherein the direction of sequential action is clockwise.

3. The method according to claim is wherein the direction of sequential action is counterclockwise 4. The method according to claim Is said step of selecting an action player further comprising:

providing a plurality of dice and an action button;

the player having the best hand in the previous round of play rolling said plurality of dice;

totalling the numeric value of said plurality of dice;

beginning with the player having the best hand in the previous round of plays the dealer sequentially counting players until the total numeric value of the dice is reached, thereby establishing the action player; and, the dealer placing said action button adjacent to the action player.

5. The method according to claim 1, wherein in said steps of comparing hands, a tie hand results in no collection of wager from either player, and the previous winning player continues play with the next sequential player.

6. The method according to claim 1, said wagers equaling a predetermined table limit.

7. The method according to claim 1, wherein said step of the players each placing a wager further includes the players contributing a predetermined collection amount to said dealer.

8. The method according to claim 1, where after said step of selecting an action players each player is given the opportunity to surrender, wherein the player forfeits one-half of his/her wager and does not participate in the hand.

9. The method according to claim 1, wherein said step of commencing with the action players the dealer dealing hands to the players includes the dealing of hands for a game selected from a plurality of different games.

10. The method according to claim 9, wherein said game is selected from the group consisting of Pan Nine, Pai Gow Poker, California Blackjack (22), Blackjack Jokers (21), and Royal Double Hand Poker.

11. The method according to claim 10, wherein for the game of Pan Nine a player must stand on 7 and above, and a tie hand results in no collection of wager from either players and the previous winning player continues play with the next sequential player.

12. The method according to claim 10, wherein for the game of Pai Gow Poker having front and back hands, in order for a player to win, he/she must either win both said front and said back hands, or win one hand and tie the other, and if each player wins one hand, no wager is collected from either player, and the stronger two-card hand continues play with the next sequential player.

13. The method according to claim 10, wherein for the game of California Blackjack if a player has two aces, subsequent players do not draw to their hands.

14. A method of apportioning wagers between a plurality of game players, wherein a dealer deals hands to each player, comprising the steps of:

the players each placing a first wager, and as desired, placing a second and third wager;

selecting an action player;

commencing with the action player, the dealer sequentially dealing hands to the players;

commencing sequentially with the action player, the first third wager-placing player and the next sequential third wager-placing player exposing and comparing hands;

the player with the best hand collecting said third wager from the other player;

the next sequential third wager-placing player exposing his/her hand and comparing it with the hand of the previous winning player;

the player with the best hand collecting said third wager from the other player;

repeating said steps of the next sequential third wager-placing player exposing his/her hand and comparing it with the hand of the previous winning player, and the player with the best hand collecting said third wager from the other player, until all third wager-placing players have participated;

commencing sequentially with the action player, the first second wager-placing player and the next sequential second wager-placing player exposing and comparing hands;

the player with the best hand collecting said second wager from the other player;

the next sequential second wager-placing player exposing his/her hand and comparing it with the hand of the previous winning player;

the player with the best hand collecting said second wager from the other player;

repeating said steps of the next sequential second wager-placing player exposing his/her hand and comparing it with the hand of the previous winning player, and the player with the best hand collecting said second wager from the other player, until all second wager-placing players have participated;

the action player and the next sequential player exposing and comparing hands;

the player with the best hand collecting said first wager from the other player;

the next sequential player exposing his/her hand and comparing it with the hand of the previous winning player;

the player with the best hand collecting said first wager from the other player; and, repeating said steps of the next sequential player exposing his/her hand and comparing it with the hand of the previous winning player, and the player with the best hand collecting said first wager from the other players until all players have participated.

15. The method according to claim 14, wherein the direction of sequential action is clockwise.

16. The method according to claim 14, wherein the direction of sequential action is counterclockwise.

17. The method according to claim 14, said step of selecting an action player further comprising:

providing a plurality of dice and an action button;

the player having the best hand in the previous round of play rolling said plurality of dice:

totalling the numeric value of said plurality of dice;

beginning with the player having the best hand in the previous round of play, the dealer sequentially counting players until the total numeric value of the dice is reached, thereby establishing the action player; and, the dealer placing said action button adjacent to the action player.

18. The method according to claim 14, wherein in said steps of comparing hands, a tie hand results in no collection of wager from either player, and the previous winning player continues play with the next sequential player.

19. The method according to claim 14, said first, second, and third wagers equaling a predetermined table limit.

20. The method according to claim 19, said predetermined table limit including:

| | |
|---|---|
| First Wager | $ 10 |
| Second Wager | $ 50 |
| Third Wager | $100 |

21. The method according to claim 19, said predetermined table limit including:

| | |
|---|---|
| First Wager | $ 25 |
| Second Wager | $100 |
| Third Wager | $200 |

22. The method according to claim 19, said predetermined table limit including:

| | |
|---|---|
| First Wager | $ 100 |
| Second Wager | $ 500 |
| Third Wager | $1000 |

23. The method according to claim 14, wherein said step of the players each placing a wager further includes the players contributing a predetermined collection amount to said dealer.

24. The method according to claim 14, wherein said step of commencing with the action player, the dealer dealing hands to the players includes the dealing of hands for a game selected from a plurality of different games.

25. The method according to claim 24, wherein said game is selected from the group consisting of Pan Nine, Pai Gow Poker, California Blackjack (22), Blackjack Jokers (21), and Royal Double Hand Poker.

26. A method of apportioning wagers between a plurality of game players, wherein a dealer deals hands to each player, comprising the steps of:

the players each placing a first wager, and as desired, placing a second and third wager;

selecting an action player and a supplemental action player;

commencing with the supplemental action player, the dealer sequentially dealing hands to the players;

commencing sequentially with the supplemental action player, the first third wager-placing player and the next sequential third wager-placing player exposing and comparing hands;

the player with the best hand collecting said third wager from the other player;

the next sequential third wager-placing player exposing his/her hand and comparing it with the hand of the previous winning player;

the player with the best hand collecting said third wager from the other player;

repeating said steps of the next sequential third wager-placing player exposing his/her hand and comparing it with the hand of the previous winning player, and the player with the best hand collecting said third wager from the other player, until all third wager-placing players have participated;

commencing sequentially with the supplemental action player, the first second wager-placing player and the next sequential second wager-placing player exposing and comparing hands;

the player with the best hand collecting said second wager from the other player;

the next sequential second wager-placing player exposing his/her hand and comparing it with the hand of the previous winning player;

the player with the best hand collecting said second wager from the other player;

repeating said steps of the next sequential second wager-placing player exposing his/her hand and comparing it with the hand of the previous winning player, and the player with the best hand collecting said second wager from the other player, until all second wager-placing players have participated;

the action player and the next sequential player exposing and comparing hands;

the player with the best hand collecting said first wager from the other player;

the next sequential player exposing his/her hand and comparing it with the hand of the previous winning player;

the player with the best hand collecting said first wager from the other player; and, repeating said steps of the next sequential player exposing his/her hand and comparing it with the hand of the previous winning player, and the player with the best hand collecting said first wager from the other player, until all players have participated.

27. The method according to claim 26, said step of selecting an action player and a supplemental action player further comprising:

providing a plurality of dice one of which is a different color from the rest;

providing an action button and a supplemental action button;

the player having the best hand in the previous round of play rolling said plurality of dice;

totalling the numeric value of said plurality of dice;

beginning with the player having the best hand in the previous round of play, the dealer sequentially counting players until the total numeric value of the dice is reached, thereby establishing the action player;

the dealer placing said action button adjacent to the action player;

the dealer noting if the action player has placed either a second or third wager;

if the action player has placed either a second or third wager, continuing normal play;

if the action player has not placed either a second or third wager, beginning with the action player the dealer sequentially counting players who have placed second or third wagers until the value of said different color die is reached, thereby establishing the supplemental action player; and, the dealer placing said supplemental action button adjacent to the supplemental action player.

28. A method of apportioning wagers between a plurality of game players, wherein a dealer deals hands to each players comprising the steps of:

the players each placing a first wager, and as desired, placing a second and third wager;

selecting an action player, a supplemental action player, and a supernumerary action player;

commencing with the supernumerary action player, the dealer sequentially dealing hands to the players;

commencing sequentially with the supernumerary action player, the first third wager-placing player and the next sequential third wager-placing player exposing and comparing hands;

the player with the best hand collecting said third wager from the other player;

the next sequential third wager-placing player exposing his/her hand and comparing it with the hand of the previous winning player;

the player with the best hand collecting said third wager from the other player;

repeating said steps of the next sequential third wager-placing player exposing his/her hand and comparing it with the hand of the previous winning player, and the player with the best hand collecting said third wager from the other player, until all third wager-placing players have participated;

commencing sequentially with the supplemental action player, the first second wager-placing player and the next sequential second wager-placing player exposing and comparing hands;

the player with the best hand collecting said second wager from the other player;

the next sequential second wager-placing player exposing his/her hand and comparing it with the hand of the previous winning player;

the player with the best hand collecting said second wager from the other player;

repeating said steps of the next sequential second wager-placing player exposing his/her hand and comparing it with the hand of the previous winning player, and the player with the best hand collecting said second wager from the other player, until all second wager-placing players have participated;

the action player and the next sequential player exposing and comparing hands;

the player with the best hand collecting said first wager from the other player;

the next sequential player exposing his/her hand and comparing it with the hand of the previous winning player;

the player with the best hand collecting said first wager from the other player; and, repeating said steps of the next sequential player exposing his/her hand and comparing it with the hand of the previous winning player, and the player with the best hand collecting said first wager from the other player, until all players have participated.

* * * * *